United States Patent [19]

Hollenberg et al.

[11] Patent Number: 4,881,558

[45] Date of Patent: Nov. 21, 1989

[54] ROTATABLE LIQUID HAIR TREATMENT MEDIUM APPLICATOR

[75] Inventors: Detlef Hollenberg, Hilden; Hans Schneider, Schwalmtal; Georg Weihrauch, Wald-Michelbach, all of Fed. Rep. of Germany

[73] Assignee: Henkel Kommanditgesellschaft auf Aktien, Duesseldorf, Fed. Rep. of Germany

[21] Appl. No.: 148,410

[22] Filed: Jan. 26, 1988

[30] Foreign Application Priority Data

Jan. 26, 1987 [DE] Fed. Rep. of Germany ..... 3702167

[51] Int. Cl.[4] ..... A45D 24/22

[52] U.S. Cl. ..... 132/112; 132/212; 401/270

[58] Field of Search ..... 132/112–115, 132/DIG. 3, 289, 212; 222/635, 631, 632

[56] References Cited

U.S. PATENT DOCUMENTS

| | | | |
|---|---|---|---|
| 2,672,875 | 3/1954 | Kovacs | 132/112 |
| 2,897,526 | 8/1959 | Dootson | 132/289 |
| 2,956,570 | 10/1960 | Stanford | 132/DIG. 3 |
| 3,961,635 | 6/1976 | Miya | 132/11 R |
| 4,055,195 | 10/1977 | Moses | 132/115 |
| 4,294,270 | 10/1981 | Cochran | 132/112 |

*Primary Examiner*—Gene Mancene
*Assistant Examiner*—J. Hakomaki
*Attorney, Agent, or Firm*—Ernest G. Szoke; Wayne C. Jaeschke; Real J. Grandmaison

[57] ABSTRACT

A rotatable liquid hair treatment medium applicator comprising a container having a distal face surrounding its opening which is at an angle to its verticle axis, a conical applicator head rotatably mounted around the mouth, and an applicator mouth co-rotatably projecting from the applicator head at an angle to the common central axis of the opening and applicator head.

6 Claims, 2 Drawing Sheets

ROTATABLE LIQUID HAIR TREATMENT MEDIUM APPLICATOR

BACKGROUND OF THE INVENTION

1. Field of the Invention

This invention relates to hand held hair treatment liquid media applicators, and in particular one which has a rotatable applicator head which is attached to a container holding such medium, and which also has static means for controlling the media flow.

2. Statement of Related Art

A hair dyeing appliance of similar type is described in German Utility Model (Gebrauchsmuster-GM) 79 32 856. The known appliance possesses a comb-like delivery aid with a channel connected through a hollow comb tine with the interior of a reservoir container and two guide or comb tines, which are arranged parallel to each other and between which is provided an opening which is in communication with the channel in the region near the comb spine. The appliance contains no means for the setting of the quantity of hair dyeing medium flowing out per unit time (flow rate regulation). The prior art appliance or the associated container must therefore be pivoted according to the flow rate requirement of the hair-dyeing medium.

A hair dyeing appliance with a brush associated with the dyeing medium is disclosed in U.S. Pat. No. 4,592,376 (and corresponding European patent document No. 38,024). According to the disclosure, especially FIGS. 9, 10, the dyeing medium is fed to the brush at the roots of the bristles. The brush spine is inclined, always invariably, relative to the longitudinal axis of the container receiving and delivering the dyeing medium. The disclosed applicator appliance also possesses a comb separate from the brush supplied with the dyeing medium.

Finally, in German patent document No. 27 49 074, there is described a hair dyeing appliance with a hollow comb element which comprises a tube with hollow tines projecting radially therefrom. The tube is connected with a container containing the dyeing medium with the interposition of a pressure reducing valve. Inserted around each tine are bristles which project beyond the tines at their free ends. Through the bristles, an even dyestuff feed and an even dyestuff distribution is attained at the same time.

When self-applied, this appliance presents difficulties in trying to treat the hair son top of the head, at the sides, and in the region at the back of the head, with the same result. Special valves are required for the opening and closing of the connection between container and applicator aid.

BRIEF DESCRIPTION OF THE INVENTION

Other than in the operating examples, or where otherwise indicated, all numbers expressing quantities of ingredients or reaction conditions used herein are to be understood as modified in all instances by the term "about".

This invention solves the problem of substantially automatically matching the quantity of treating medium supplied to the hair to the requirements of the respective hair treating task, and makes it possible to disperse amounts which may be set between zero and a maximum, without the use of valves. The solution according to the invention comprises rotatably mounting the applicator head on the container, using pivot means such as a lead screw, with the aid of a thread coaxially surrounding the mouth of the container. As a result the medium passage means, such as a medium channel which connects the mouth of the container with the dispensing exit of the applicator, and ends in a nipple adjoining the mouth, may be opened or closed by rotation of the applicator head. The container, which forms the handle of the inventive device, is preferably generally cylindrical.

Separate sealing means for preventing the flow of medium from the container are not required, since the applicator head can fulfill such function. Furthermore, the medium outflow from the container can be preset by a more or less wide margin through rotation of the applicator head relative to the container using the lead screw, or the like. A particularly advantageous hair treating device is obtained when a nipple adjoining the mouth of the container opens into the innermost of a plurality of cylindrical annular channels or appendages of the applicator head and the wall thickness of the nipple is fitted exactly into the cylindrical annular channel so that it biases against its inside wall and prevents media flow around the nipple. Furthermore, the outside wall of the cylindrical annular channel extends in the direction of the nipple further than its inside wall by at least the annular gap width. The cylindrical channel is generally coaxial with the rotational axis of the applicator. All of the cylindrical appendages are coaxial and are complementary to corresponding annular steps forming the container mouth.

Preferably the applicator head possesses applicator means comprising one or more, preferably two, preferably parallel, guide tines in the manner of comb tines and an exit opening for the hair treating medium between the comb tines. It can also be favorable when bristles or bundles of bristles, which extend substantially parallel to the longitudinal direction of the guide tines, are arranged immediately around the exit opening and in the region between the guide tines, forming a rim not extending beyond the tines. Most preferably the bristles are in a plurality of bundles whose bundle central axes are set an angle of 45° to the central axis of the applicator head. The comb tines are preferably in the form of a planar half hyperbola or half hyperboloid of two sheets, adjacent the bristles outward from the exit opening. The comb tines should be of equal length to, or preferably longer than, the bristles. Through the mounting of the bristles immediately around the exit opening so that they carry the hair treatment medium outward to the end of the tines, a valve-like braking effect is produced so that the quantity of outflowing medium is determined not by the width of the opening of the exit channel, but rather by the capillary or similar action of the bristles during application and/or by the pressure acting from the container.

The applicator head, according to the invention, which should be geometrically pointed in direction towards the guide tines, can be used as a replacement for the cap of the container, and can be marketed either permanently rotatably affixed to the container, or for later rotatable attachment. The attaching means can be any known in the art, such as a screw-fit, click-fit, etc. Once attached, it is preferable that the applicator head not be removable.

When used as a rotatable applicator in combination with the container, the base of the applicator head should be circular, and adjoin a circular lid area which is inclined through 45° to the vertical axis of the container. At the same time, it can be advantageous to lay the rotational axis of the applicator head into the central normal passing through the center point of the container lid area as well as the base of the applicator head. In a given case, it can be favorable to orient the guide tines so that they are inclined through 45° to the rotational axis of the applicator head in such a manner that the longitudinal direction of the guide tines is parallel to the longitudinal axis of the container in one rotational setting of the applicator head and perpendicular to the longitudinal axis of the container in a rotational setting pivoted through 180°. Through a 180° rotation around the rotational axis of the applicator head, the guide tines and thereby the guide slot formed between them can then be pivoted through 90°, i.e. out of the parallel into the perpendicular (and conversely) to the main axis of the container, which serves as the appliance handle. Advantageously, the applicator head can have substantially the shape of a circular comb with a conical height agreeing with the cone base diameter. The guide tines are then disposed in the region of the mostly rounded-off cone point wherein a slot opening containing the bristles extends between the tines. Through the inventive compact and rounded arrangement of a straight or slanted conical pivoting shape, a strand of hairs may be introduced conveniently into the applicator slot between the guide tines and dyed down to the roots through reciprocating movement, without dyeing adjacent hair, thus permitting the introduction of color highlights and other desired effects.

To summarize, the inventive device comprises (A) a container for a hair treating medium, which is generally cylindrical and capable of being held in one hand, with an opening on its top, which opening extends outward perpendicularly from a container distal face, the plane of which container is angularly disposed with respect to the vertical axis of the container, and wherein preferably the opening central axis intersects the container vertical axis at a 45° angle, the opening comprising a plurality (preferably 2 or 3) of concentric annular rising steps of decreasing diameter:

(B) an applicator head rotatably mounted upon the container opening concentrically with the opening central axis by rotatable mounting means, with a generally conical outer surface concentric with the opening central axis and with one or more descending interior cylindrical appendages adapted to complement and envelope one or more of the above annular steps; projecting from the applicator head and co-rotatable therewith from a closed first position in vertical alignment with the vertical axis of the container to an open second position in angular (preferably perpendicular) alignment with the vertical axis and further to an open third position again in vertical alignment with the vertical axis;

(C) applicator mouth means projecting from the applicator head and co-rotatable therewith from a closed first position in vertical alignment with the vertical axis of the container to an open second position in angular alignment with the vertical axis and further to an open third position again in vertical alignment with the vertical axis;

(D) passage means communicating between the applicator mouth means and the interior of the container, so that hair treatment medium may flow from the container through its top opening, through the applicator head, and out the applicator mouth means, when the applicator head is in an open position; and (E) sealing means for preventing the flow of medium when the applicator head is in its first position.

BRIEF DESCRIPTION OF THE DRAWING

Details of the invention are explained by reference to the schematic illustration of an example of embodiment.

DETAILED DESCRIPTION OF THE INVENTION

Figure 1:
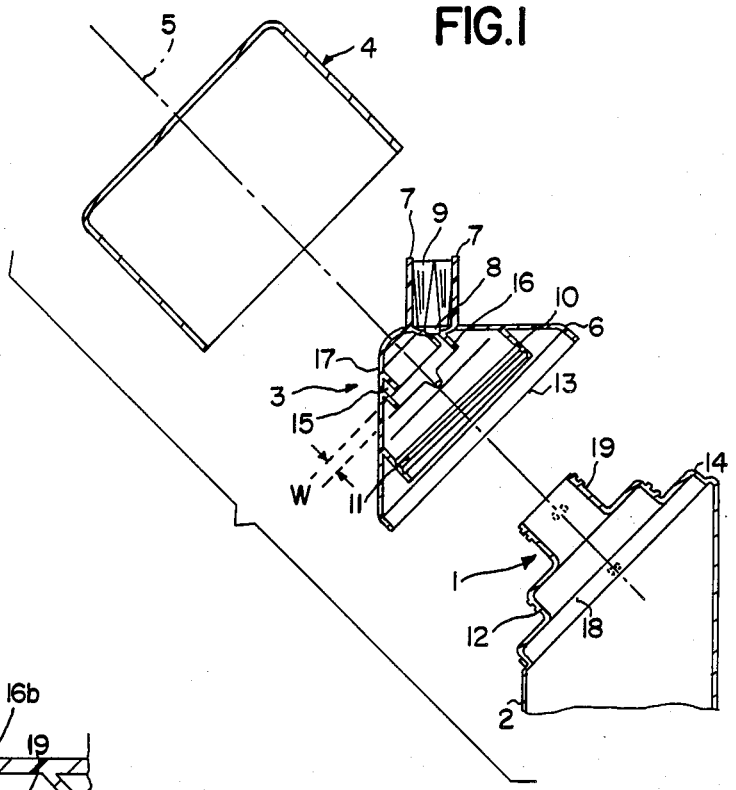
FIG. 1 is an exploded view in section of an applicator system.
Figure 3B:
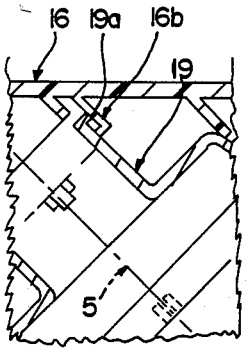
FIGS. 3 and 4 are open applicator heads in different pivotal settings and with partially or completely opened exit channel; and FIG. **3*b* is an enlarged detail of FIG. 3**.

In the exploded view according to FIG. 1, the opening region, designated generally as 1, of a container 2, an applicator head 3 and a cap 4 are illustrated in section. According to FIGS. 2 to 4, the individual parts of FIG. 1 can be put together in the direction of the longitudinal opening central axis 5. The cap 4 is not required for the functioning or for the closing of the appliance. It merely protects against other articles, for example clothing, coming into contact with the applicator head 3 if it is still carrying remnants of hair dye or other fluid medium.

The applicator head 3 in one embodiment possesses substantially the shape of a circular cone with applicator means projecting perpendicularly from the shell surface 6 and formed by two tines 7. An exit opening 8 for the hair treatment medium is disposed between the tines 7 in the shell surface 6. Bristles 9 can be provided between the tines 7 immediately around the exit opening. The slope of the cone is 45° to the opening central axis 5 and the tines 7 are oppositely inclined through 45° relative to the opening central axis 5, and therefore 90° relative to the slope.

The applicator head 3 within the shell area 6 houses an appending cylinder 10 for attaching to the container, and which is coaxial with the circular cone, having an internal thread 11, which is complementary to an external thread of a corresponding step or attachment projection 12 in the opening region 1 of the container 2. Optionally, the base rim of the shell area 6 can comprise a cylindrical outer appendage or projection 13, which is to be inverted appropriately over a complementary cylindrical circumferential step or rim 14 of the opening region 1 of the container 2. Although elements 10, 12 are illustrated with a screw fit, a bayonet-fit or a glue or thermal seal may also be utilized. Thus, any connecting means may be utilized for connecting the container and the rotatable applicator head.

The exit opening 8 of the shell area 6 communicates with a cylindrical annular channel 15 molded coaxially with the circular cone and integral with the inside surface of the applicator head 3. This channel comprises an outside wall 16 and an inside wall 17. The outside wall 16 of the cylindrical annular channel 15 extends in the direction of the opening region 1 of the container 2 further than the inside wall 17 by at least the annular gap width w, which gap is adequate to permit flow of the medium when opened.

Associated with the annular channel 15 of the applicator head 3 as part of the opening region 1 of the container 2 is a flange 19 adjoining its mouth 18. The mouth 18 of the container 2 and the flange 9, as well as the external thread 12 and the cylindrical circumferential rim 14, are axially symmetrical to the opening central axis 5. The cylindrical annular channel 15, too, is molded to the inside of the shell area 6 axially symmetrically with respect to the longitudinal axis 5. The flange 19 is of a size to fit exactly into the cylindrical annular channel 15 so that on one hand the connection between container 2 and exit opening 8 by way of the cylindrical annular channel 15 is plugged on complete entry of the flange 19 into the channel 15. On the other hand, the annular channel 15 is flowingly opened when the flange 19 is removed. The degree of removal or plugging can control the rate of flow of the medium from the container 2 out through the exit opening 8. The different positions are illustrated schematically in FIGS. 2 to 4.

Figure 2:
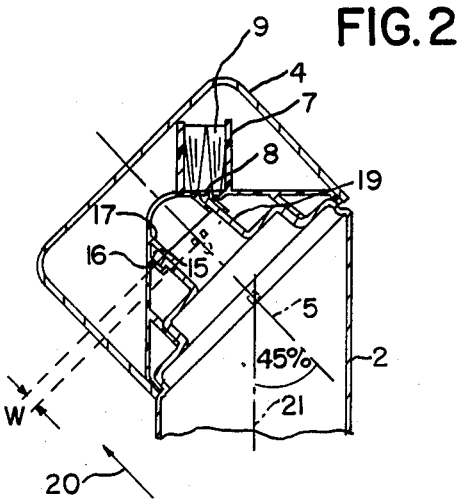
FIG. 2 is a closed assembled applicator head.

FIG. 2 shows the inventive appliance with the applicator head 3 disposed in the closed setting and a cap 4 placed thereon. When using the inventive device, the cap 4 is removed and the applicator head 3 is rotated to whichever position is most favorble for application to the hair or other object to be treated, while the entire appliance is held by the container.

Figure 3:
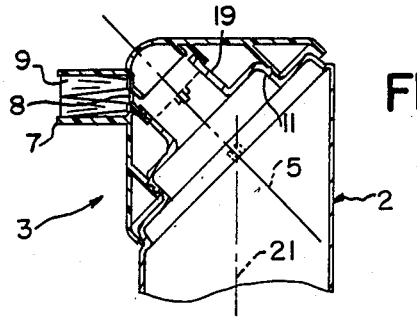

Rotating the applicator head 3 acts to displace it longitudinally along the opening central axis from the container 2. FIG. 3 shows applicator head 3 rotated 180° from that of FIG. 2, which partially unplugs annular channel 15. Further rotation to a total of 360° displaces the applicator head 3 still farther, completely opening annular channel 15, as shown in FIG. 4.

Figure 4:
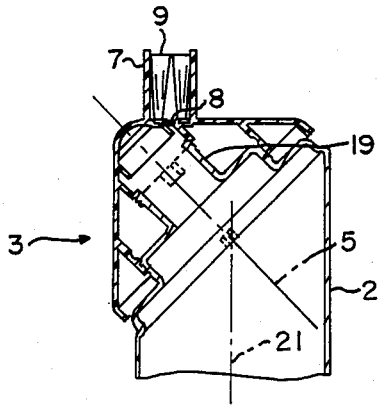

Thus, upon rotation about the opening central axis 5 from the position in FIG. 2 into that according to FIG. 3 or FIG. 4, the applicator head 3 is displaced in arrow direction 20 relative to the opening region 1 of the container 2, because the internal thread 10 is rotated relative to the external thread 11 (in the manner of a lead screw). The displacement of the applicator head 3 relative to the container 2 also causes the flange 19 gradually to be drawn out of the cylindrical annular region 15 in such a manner that, in the case of FIG. 3, it just emerges out of the cylindrical annular channel 15 and a narrow gap is opened between the interior of the flange and the annular channel leading to the exit opening 8. On further rotation of the applicator head 3 about the longitudinal axis 5, the flange 19 is completely withdrawn from the region of the cylindrical annular channel 15 so that an unhindered flow of medium by way of the cylindrical annular channel 15 is possible, beginning in the interior of the container 2 and exiting at opening 8. The cylindrical annular channel 15 can be closed again through rescrewing of the applicator turret 3. As shown in FIG. **3*b*, the applicator head 3 is prevented from further longitudinal displacement by a nipple 19*a* on flange 19 biasing against at least one pin 16*b* which projects inwardly from exterior wall 16** parallel to the opening central axis.

In the position according to FIG. 2, the applicator head with the tines 7 and the bristles 9 is disposed in a position approximately perpendicular to the longitudinal direction 21 of the container 2. In the pivotal setting according to FIG. 4, the applicator head with the tines 7 is disposed in a position about parallel to the longitudinal direction 21 of the container 2. Such pivotal settings, which result at an inclination of 45° of the longitudinal axis 5 to the longitudinal direction 21, are particularly favorable for certain hair dyeing tasks, particularly in the case of self application, in the rear and front scalp region.

It is extremely desirable to produce a more or less strong hair treatment, especially dye application which is uniform in all areas to which applied, independent of the region of the scalp. In a preferred embodiment this can be achieved by arranging bristles 9 immediately around the exit opening 8 and between the tines 7 of the applicator head. The bristles exert a valve-like braking effect on the hair-dyeing medium flowing forward (perhaps through a meniscus).

At the same time, pressure exerted on the (preferably) elastic container, in combination with flow characteristics caused by the bristle arrangement (i.e., capillary action), cause a positive flow of medium, counteracted in part by the braking action of the bristle arrangement (i.e. menisci). The net result is that the application rate of dye medium to the hair is easily regulated by varying the intervals, time, or amount of the pressure applied to the container. It is thus possible to achieve a uniform or (when desired) non-uniform application of dye or other medium to the hair. Moreover, the inventive device may easily be used for self-application.

While this description is primarily written in terms of the preferred embodiment of hair dye application, the inventive device is also useful for dispensing other hair treatment media to be applied selectively, including curling or straightening lotions, setting lotions, bleaches, and the like.

The material from which the inventive adapter and applicator head are manufactured can be any suitable plastic, and the composition of these items does not otherwise form a part of this invention. The container, with projecting threaded neck for receiving the adapter, is not limited as to construction material, except that the hair treating medium must be expressible therefrom. For this reason, the container is preferably an elastic plastic. The container, applicator head, and adaptor, may all be formed of the same or of different materials. The nature of the container does not form a part of this invention, other than that it must have a projection upon which the adapter can be mounted, and that it is preferably of a size and shape adapted to be held by the hand while applying the medium contained therein to one's own hair.

The nature and composition of the medium stored in the container does not form a part of this invention other than that it must be sufficiently fluid to be expressed from the container, through the adapter, and exit at the applicator head through the applicator mouth means. It is contemplated that media most useful for dispensing in the inventive device will be hair treating fluids, such as dyes, bleaches, conditioners, waving lotions, and the like. Hair dye solutions are contemplated as particularly suitable.

We claim:

1. A rotatable liquid hair treatment medium applicator comprising:

a container for a liquid hair treatment medium, which is generally cylindrical and capable of being held in one hand, having an opening on its top extending outward perpendicularly from a container distal face, the plane of which face is angularly disposed with respect to the vertical axis of the container, which opening comprises a plurality of concentric rising annular steps of decreasing diameter;

an applicator head rotatably mounted upon the container opening concentrically with the container opening central axis, having a generally conical outer surface concentric with the container opening central axis, and one or more descending interior cylindrical appendages concentric with the opening central axis and adapted to complement and envelope one or more of said annular steps;

applicator mouth means projecting from the applicator head at an angle to the opening central axis and co-rotatable therewith from a closed first position in vertical alignment with the vertical axis of the container to an open second position in angular alignment with the vertical axis and farther to an open third position again in vertical alignment with the vertical axis;

passage means communicating between the applicator mouth means and the interior of the container, so that hair treatment medium may flow from the container through its opening, through the applicator head, and out the applicator mouth means, when the applicator head is an open position;

sealing means for preventing the flow of medium when the applicator head is in its first position; and said distal annular step of said container opening consisting of a nipple whose outer edge moveably biases in an axial direction against the inside of the innermost cylindrical appendage of the applicator head upon rotation of said applicator head, so that fluid flow between the nipple and the cylindrical appendage is effectively controlled.

2. The applicator of claim 1 wherein the applicator head is rotatably mounted upon the container opening by mounting means comprising a lead screw in which the container opening is the male and the applicator head is a complementary female.

3. The applicator of claim 1 wherein said applicator mouth means comprises a plurality of bristles surrounding the exit opening of the passage means, said bristles being generally in a plurality of bundles set at a 45° angle to the central axis of the applicator head, and at least one comb tine in the form of a planar half-hyperbola or half-hyperboloid of two sheets, adjacent said bristles outward from said exit opening, projecting parallel to said bristles for at least the same length as said bristles.

4. The applicator of claim 2 wherein said applicator mouth means comprises a plurality of bristles surrounding the exit opening of the passage means, said bristles being generally in a plurality of bundles set at a 45° angle to the central axis of the applicator head, half-hyperboloid of two sheets, adjacent said bristles outward from said exit opening, projecting parallel to said bristles for at least the same length as said bristles.

5. The applicator of claim 3 wherein two parallel comb tines are present, one on each side of said plurality of bristles.

6. The applicator of claim 4 wherein two parallel comb tines are present, one on each side of said plurality of bristles.

* * * * *

UNITED STATES PATENT AND TRADEMARK OFFICE

CERTIFICATE OF CORRECTION

PATENT NO. : 4,881,558

DATED : November 21, 1989

INVENTOR(S) : Hollenberg et al.

It is certified that error appears in the above-identified patent and that said Letters Patent is hereby corrected as shown below:

In Claim 4, at Column 8, line 18, after "applicator head," should read --and at least one comb tine in the form of a planar half-hyperbola or--.

Signed and Sealed this

Fifth Day of February, 1991

*Attest:*

HARRY F. MANBECK, JR.

*Attesting Officer*

*Commissioner of Patents and Trademarks*